US011127360B2

(12) United States Patent
Oh et al.

(10) Patent No.: US 11,127,360 B2
(45) Date of Patent: Sep. 21, 2021

(54) LIQUID CRYSTAL DISPLAY DEVICE AND METHOD OF DRIVING THE SAME

(71) Applicant: Samsung Display Co., Ltd., Yongin-si (KR)

(72) Inventors: Kwan-Young Oh, Hanam-si (KR); Suk Jin Park, Daejeon (KR); Youngsoo Sohn, Yongin-si (KR); Wonhee Lee, Bucheon-si (KR); Jae Hyoung Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 120 days.

(21) Appl. No.: 16/575,202

(22) Filed: Sep. 18, 2019

(65) Prior Publication Data

US 2020/0090596 A1 Mar. 19, 2020

(30) Foreign Application Priority Data

Sep. 19, 2018 (KR) ..... 10-2018-0112213

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01); *G09G 3/3648* (2013.01);
(Continued)

(58) Field of Classification Search
CPC ..... G09G 3/3406; G09G 3/36; G09G 2320/0247; G09G 2310/08; G09G 2340/0435; G09G 2320/064; G09G 3/3611; G09G 2320/0646; G02F 1/133615; G02F 1/133603
See application file for complete search history.

(56) References Cited

U.S. PATENT DOCUMENTS

2012/0147291 A1* 6/2012 Seo ..... G09G 3/342 349/62
2013/0021387 A1* 1/2013 Takahashi ..... H04N 21/440281 345/690

(Continued)

FOREIGN PATENT DOCUMENTS

KR 10-0832209 B1 5/2008
KR 10-2014-0084838 A 7/2014

(Continued)

*Primary Examiner* — Patrick N Edouard
*Assistant Examiner* — Douglas M Wilson
(74) *Attorney, Agent, or Firm* — Lewis Roca Rothgerber Christie LLP

(57) ABSTRACT

A liquid crystal display device comprising, a liquid crystal display panel, a timing controller configured to output a light-source controlling signal during a variable frequency mode comprising a plurality of frames with variable frame frequencies, the light-source controlling signal having a high level during a light-on period preset in an early period of a frame of the plurality of frames and a low level during a light-off period preset to a length according to a frame frequency in a latter period of the frame of the plurality of frames, and a light source configured to emit light during the light-on period and not emit light during the light-off period in response to the light-source controlling signal.

16 Claims, 10 Drawing Sheets

(52) U.S. Cl.
CPC . *G09G 2310/0237* (2013.01); *G09G 2310/08* (2013.01); *G09G 2320/0247* (2013.01); *G09G 2320/064* (2013.01); *G09G 2340/0435* (2013.01)

(56) References Cited

U.S. PATENT DOCUMENTS

| | | | | |
|---|---|---|---|---|
| 2016/0232855 | A1* | 8/2016 | Tada | G09G 3/3406 |
| 2018/0007311 | A1* | 1/2018 | Kato | G09G 5/36 |
| 2018/0033379 | A1* | 2/2018 | Li | G09G 3/2074 |
| 2018/0061352 | A1 | 3/2018 | Kim et al. | |
| 2018/0166033 | A1* | 6/2018 | Takahashi | G09G 3/3614 |
| 2019/0164506 | A1* | 5/2019 | Wu | G02F 1/133602 |
| 2019/0244572 | A1* | 8/2019 | Le | G09G 3/342 |
| 2019/0378459 | A1* | 12/2019 | Kim | G09G 3/3258 |
| 2020/0090597 | A1* | 3/2020 | Chen | G09G 5/003 |
| 2020/0226986 | A1* | 7/2020 | Meng | G09G 3/3406 |
| 2020/0329213 | A1* | 10/2020 | Kato | G09G 5/36 |

FOREIGN PATENT DOCUMENTS

| | | | |
|---|---|---|---|
| KR | 10-2016-0084035 | A | 7/2016 |
| KR | 10-2017-0051795 | A | 5/2017 |

* cited by examiner

LIQUID CRYSTAL DISPLAY DEVICE AND METHOD OF DRIVING THE SAME

CROSS-REFERENCE TO RELATED APPLICATION

This application claims priority to and the benefit of Korean Patent Application No. 10-2018-0112213 filed on Sep. 19, 2018, the entire content of which is incorporated herein by reference.

BACKGROUND

1. Field

An embodiment of the present invention relates to a liquid crystal display device, and more particularly to a liquid crystal display device for improving a display quality and a method of driving the liquid crystal display device.

2. Description of the Related Art

In general, a liquid crystal display (LCD) device includes a liquid crystal display panel for displaying an image using light transmittance of a liquid crystal, a driving circuit for driving the liquid crystal display panel, and a backlight unit for providing light to the liquid crystal display panel.

An external graphics processing unit (GPU) changes the image frame rate of an image frame constituting image data in real time. A scaler adjusts the image frame rate to a panel frame rate of a panel driving frame for displaying an image on the liquid crystal display panel. The scaler also provides the image frame rate to the liquid crystal display device.

When the image frame rate is slower or faster than the panel frame rate, the image of the current frame is outputted to the liquid crystal display device, or the image of the next frame is outputted while the image of the current frame is being output. Accordingly, a tearing phenomenon (tearing) occurs when the screen displayed on the liquid crystal display device is cut off.

In order to reduce or prevent tearing, the scaler operates in the vertical synchronization mode for vertical synchronization. In the vertical synchronization mode, when the frame rate is slow, the scaler repeatedly outputs the image of the previous frame to the liquid crystal display device. As a result, a picture displayed on the liquid crystal display device is delayed (stuttering).

In order to solve the problem that occurs as the image frame rate varies, an adaptive synchronization technique has been proposed in which the vertical blank interval in the panel driving frame is increased or decreased to match the image frame rate. As the vertical blank interval in the panel driving frame is different, the average luminance of the liquid crystal display panel is changed for each frame. Accordingly, a defective display such as a flicker may be visually recognized.

SUMMARY

Aspects of some exemplary embodiments are directed toward a liquid crystal display device for improving a luminance according to a variable frequency mode.

Aspects of some exemplary embodiments are directed toward a method of driving the liquid crystal display device.

According to an exemplary embodiment of the inventive concept, there is provided a liquid crystal display device including a liquid crystal display panel, a timing controller configured to output a light-source controlling signal during a variable frequency mode comprising a plurality of frames with variable frame frequencies, the light-source controlling signal having a high level during a light-on period preset in an early period of a frame of the plurality of frames and a low level during a light-off period preset to a length according to a frame frequency in a latter period of the frame of the plurality of frames, and a light source configured to emit light during the light-on period and not emit light during the light-off period in response to the light-source controlling signal.

In an exemplary embodiment, the timing controller may include a frequency mode determiner configured to determine whether a frequency mode is the variable frequency mode using a synchronization signal, and a light-source controlling signal generator configured to generate the light-source controlling signal when the frequency mode is the variable frequency mode.

In an exemplary embodiment, the frequency mode determiner may be configured to determine the frequency mode using a counting value of the synchronization signal corresponding to a vertical blank period of the frame of the plurality of frames.

In an exemplary embodiment, the timing controller may be configured to output a light-source controlling signal having the high level throughout the frame of the plurality of frames during a normal frequency mode comprising a plurality of frames with constant frame frequencies.

In an exemplary embodiment, the length of the light-on period may correspond to a frame length of 120 Hz.

In an exemplary embodiment, the length of the light-on period may correspond to a frame length of a highest frequency from among a variable frequency range in the variable frequency mode.

In an exemplary embodiment, the length of the light-on period may correspond to a frame length of a frequency higher than a highest frequency from among a variable frequency range in the variable frequency mode.

In an exemplary embodiment, the timing controller may be configured to output a light-source controlling signal having the high level throughout the frame of the plurality of frames when the length of the frame of the plurality of frames is shorter than the light-on period during the variable frequency mode.

In an exemplary embodiment, the liquid crystal display device may further include a light-source driver configured to generate a light-source driving signal having a pulse width modulation level corresponding to the high level of the light-source controlling signal and a low level corresponding to the low level of the light-source controlling signal.

According to an exemplary embodiment of the inventive concept, there is provided a method of driving a liquid crystal display device. The method includes outputting a light-source controlling signal during a variable frequency mode comprising a plurality of frames with variable frame frequencies, the light-source controlling signal having a high level during a light-on period preset in an early period of a frame of the plurality of frames and a low level during a light-off period preset to a length according to a frame frequency in a latter period of the frame of the plurality of frames, lighting a liquid crystal display panel during the light-on period of the frame based on the light-source controlling signal during the variable frequency mode, and not lighting the liquid crystal display panel during the light-off period of the frame based on the light-source controlling signal during the variable frequency mode.

According to an exemplary embodiment of the inventive concept, there is provided a method of driving a liquid crystal display device. The method includes means for outputting a light-source controlling signal during a variable frequency mode comprising a plurality of frames with variable frame frequencies, the light-source controlling signal having a high level during a light-on period preset in an early period of a frame of the plurality of frames and a low level during a light-off period preset to a length according to a frame frequency in a latter period of the frame of the plurality of frames, means for lighting a liquid crystal display panel during the light-on period of the frame based on the light-source controlling signal during the variable frequency mode, and means for not lighting the liquid crystal display panel during the light-off period of the frame based on the light-source controlling signal during the variable frequency mode.

In an exemplary embodiment, the method may further include determining whether a frequency mode is the variable frequency mode using a synchronization signal and generating the light-source controlling signal when the frequency mode is the variable frequency mode.

In an exemplary embodiment, the frequency mode may be determined using a counting value of the synchronization signal corresponding to a vertical blank period of the frame of the plurality of frames.

In an exemplary embodiment, the method may further include outputting a light-source controlling signal having the high level throughout the frame of the plurality of frames during a normal frequency mode which includes a plurality of frames with constant frame frequencies.

In an exemplary embodiment, the length of the light-on period may correspond to a frame length of 120 Hz.

In an exemplary embodiment, the length of the light-on period may correspond to a frame length of a highest frequency from among a variable frequency range in the variable frequency mode.

In an exemplary embodiment, the length of the light-on period may correspond to a frame length of a frequency higher than a highest frequency from among a variable frequency range in the variable frequency mode.

In an exemplary embodiment, the method may further include outputting a light-source controlling signal having the high level throughout the frame of the plurality of frames when the length of the frame of the plurality of frames is shorter than the light-on period in the variable frequency mode.

In an exemplary embodiment, the method may further include generating a light-source driving signal having a pulse width modulation level corresponding to the high level of the light-source controlling signal and a low level corresponding to the low level of the light-source controlling signal and providing the light-source driving signal to a light source.

According to the inventive concept, even when the vertical blank period varies during the variable frequency mode, a flicker due to a luminance difference occurring in the variable frequency mode may be reduced or minimized because the same light-on period is applied. However, a black insertion corresponding to the light-off period according to the light-on period is not observed by the user as a high-frequency component. Therefore, the display quality of the image may be improved in the variable frequency mode.

BRIEF DESCRIPTION OF THE DRAWINGS

The above and other features and advantages of the inventive concept will become more apparent by describing in detailed exemplary embodiments thereof with reference to the accompanying drawings, in which.

DETAILED DESCRIPTION

Hereinafter, the inventive concept will be explained in more detail with reference to the accompanying drawings.

Figure 1:
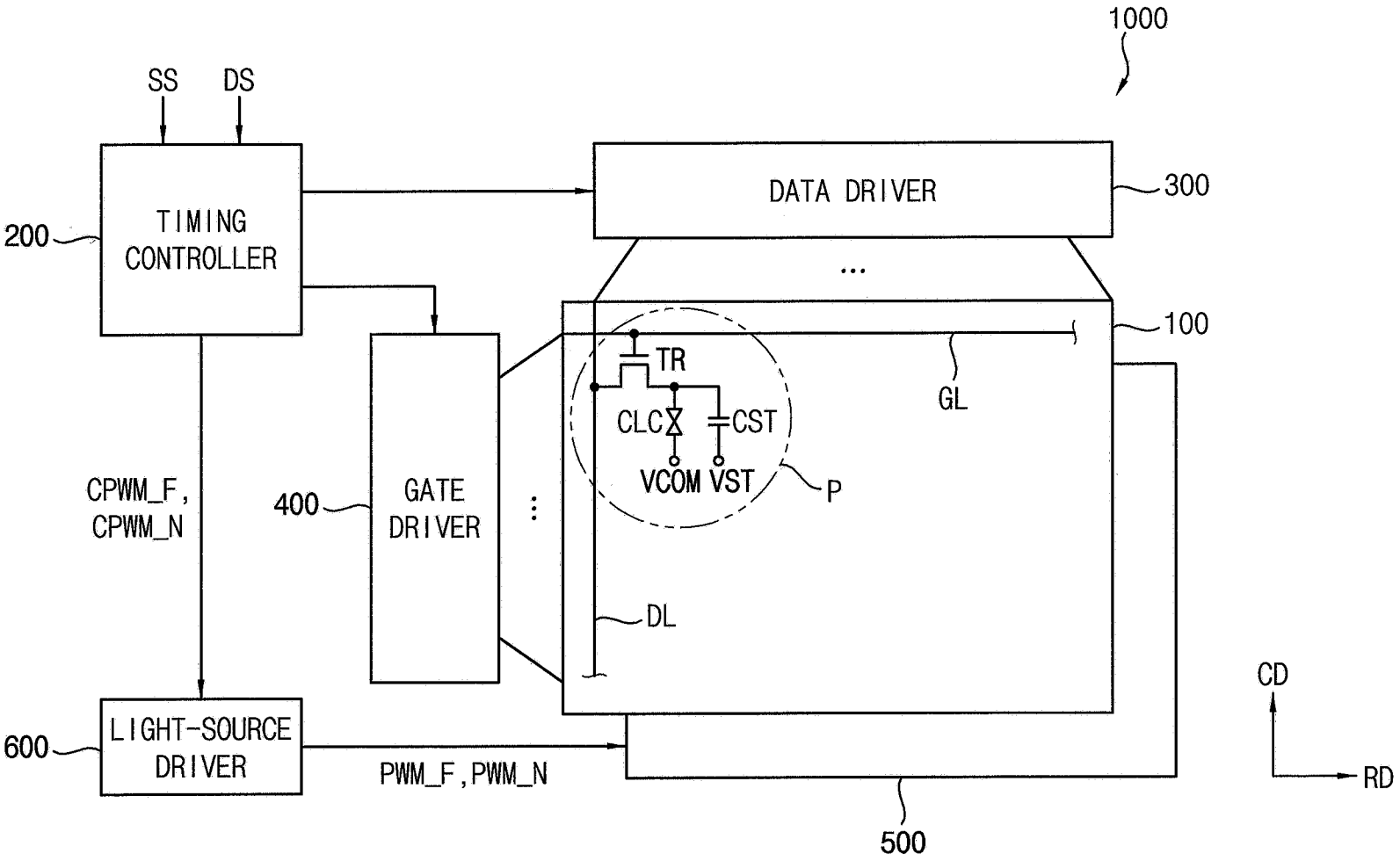
FIG. 1 is a block diagram illustrating a display device according to an exemplary embodiment.
Figure 2A:
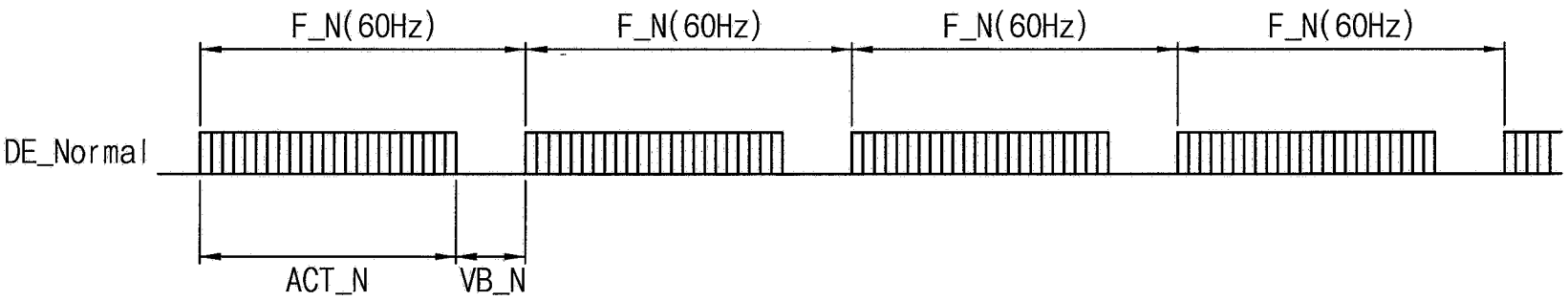
FIGS. 2A and 2B are waveform diagrams illustrating a synchronization signal in a normal frequency mode according to an exemplary embodiment.
Figure 2B:
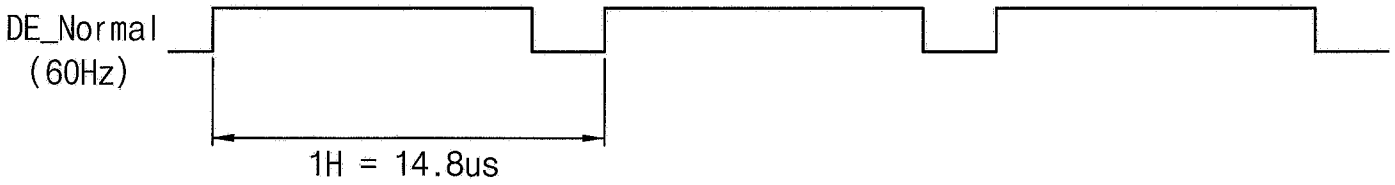
Figure 3A:
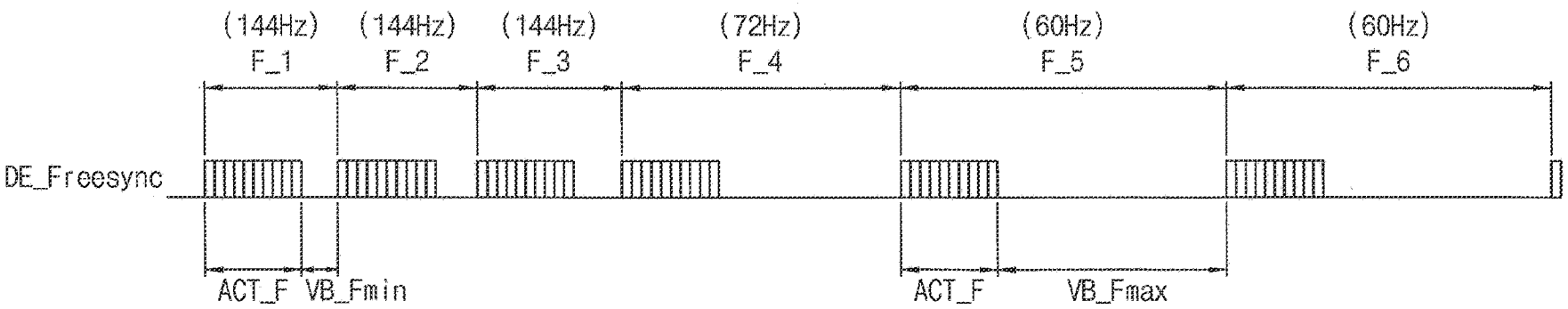
FIGS. 3A and 3B are waveform diagrams illustrating a synchronization signal in a variable frequency mode according to an exemplary embodiment.
Figure 3B:
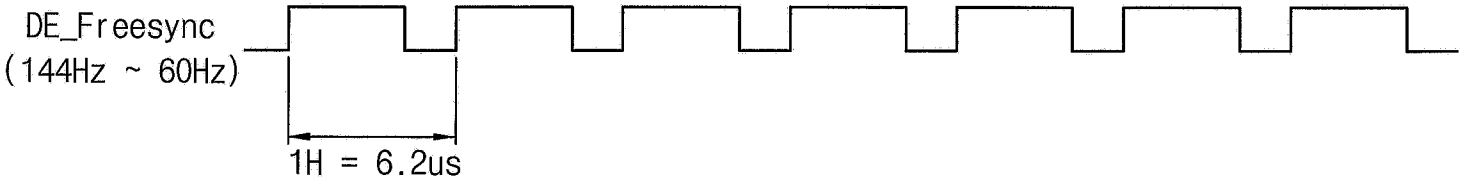

FIG. 1 is a block diagram illustrating a display device according to an exemplary embodiment. FIGS. 2A and 2B are waveform diagrams illustrating a synchronization signal in a normal frequency mode according to an exemplary embodiment. FIGS. 3A and 3B are waveform diagrams illustrating a synchronization signal in a variable frequency mode according to an exemplary embodiment.

Referring to FIG. 1, the liquid crystal display device 1000 may include a liquid crystal display panel 100, a timing controller 200, a data driver 300, a gate driver 400, a light source 500 and a light-source driver 600.

The liquid crystal display panel 100 may include a plurality of data lines DL, a plurality of gate lines GL and a plurality of pixels P.

The plurality of data lines DL may extend in a column direction CD and may be arranged with each other in a row direction RD intersecting or crossing the column direction CD. The plurality of gate lines GL may extend in the row direction RD and may be arranged with each other in the column direction CD.

The plurality of pixels P may be arranged in a matrix form including a plurality of pixel rows and a plurality of pixel columns. Each pixel P may include a transistor TR connected to a data line DL and a gate line GL, a liquid crystal capacitor CLC connected to the transistor TR, and a storage capacitor CST connected to the liquid crystal capacitor CLC. The liquid crystal common voltage VCOM is applied to the liquid crystal capacitor CLC, and the storage common voltage VST is applied to the storage capacitor CST. The liquid crystal common voltage VCOM and the storage common voltage VST may be the same voltage.

The timing controller 200 receives an image signal DS and a synchronization signal SS from a graphics processing unit (GPU).The GPU may be an external device.

For example, the timing controller 200 may receive an image signal and a synchronization signal of a normal frequency mode. In addition, the timing controller 200 may receive an image signal and a synchronization signal of a variable frequency mode.

Referring to a data enable signal DE_Normal of the normal frequency mode, as shown in FIGS. 2A and 2B, a frame F_N may include an active period ACT_N and a vertical blank period VB_N. In the normal frequency mode, each of a plurality of frames may include an active period ACT_N and a vertical blank period VB_N. The active period ACT_N of each of the plurality of frames may be the same length. The vertical blank period VB_N of each of the plurality of frames may be the same length. When the plurality of frames in the normal frequency mode has a frame frequency of 60 Hz, 1-horizontal period 1H of the data enable signal DE_Normal may be about 14.8 μs.

Referring to a data enable signal DE_Freesync of the variable frequency mode, as shown in FIGS. 3A and 3B, the plurality of frames may have various frequencies. For example, first to third frames F_1 to F_3 have a frame frequency of 144 Hz, a fourth frame F_4 has a frame frequency of 72 Hz, fifth and sixth frames F_5 and F_6 have a frame frequency of 60 Hz. As described above, the frame frequencies in the variable frequency mode may be varied within a variable frequency range from a lowest frequency to a highest frequency. For example, the variable frequency range may be about 60 Hz to about 144 Hz. In the variable frequency mode, the active period ACT_F of each of the plurality of frames may have the same length irrespective of the frame frequencies, but the vertical blank period VB_F of each of the plurality of frames may have a different length depending on the frame frequencies.

For example, when the variable frequency range is about 60 Hz to about 144 Hz, the vertical blank period VB_Fmax of 60 Hz that is the lowest frequency is the longest, and the vertical blank period VB_Fmin of 144 Hz that is the highest frequency is the shortest. Thus, when the variable frequency range is about 60 Hz to about 144 Hz, the 1-horizontal period 1H of the data enable signal DE_Freesync may be about 6.2 μs.

As described above, in the variable frequency mode, when the frame frequency decreases, the length of the vertical blank period increases. When the length of the vertical blank period increases, a holding time in which the data voltage is maintained in the pixel frame increases. Thus, a luminance of a pixel may be decreased by a leakage current of the pixel. By this luminance reduction, when the image signal of the current frame is the same as the image signal of the next frame or the background image is similar, a luminance difference may occur and the luminance difference may be observed as a flicker phenomenon.

According to an exemplary embodiment, in the variable frequency mode, the light-on period during which the light source may emit light may be preset in an early period of the frame and the light-off period during which the light source may not emit light may be preset in a latter period of the frame. The light-off period may be a separate period from the light-on period. Therefore, the luminance difference due to the leakage current as the vertical blank period is lengthened may be prevented from being visible to the user by turning off the light source. In addition, the luminance difference may be reduced or minimized by keeping the light-on period in which the light source emits light for every frame.

In the variable frequency mode, the timing controller 200 may generate a light-source controlling signal to control the light-source driver 600 to emit light from the light source 500 during the light-on period and to not emit light from the light source 500 during the light-off period. However, in the normal frequency mode, the timing controller 200 may generate a light-source controlling signal to control the light source 500 to emit light from the light source 500 throughout the period of the frame.

The timing controller 200 may generate a plurality of control signals based on the synchronization signal SS. The plurality of control signals may include a data control signal for controlling the data driver 300 and a gate control signal for controlling the gate driver 400. The timing controller 200 may correct the image signal DS through various correction algorithms and may provide a corrected image signal to the data driver 300.

The data driver 300 may convert the image signal into a data voltage using a gamma voltage for each horizontal period based on the data control signal, and outputs the data voltage to the data line DL.

The gate driver 400 may generate a plurality of gate signals based on the gate control signal and sequentially output the plurality of gate signals to the plurality of gate lines GL.

The light source 500 may provide light to the liquid crystal display panel 100. The light source 500 may emit light based on a light-source driving signal provided from the light-source driver 600. The light source 500 may include a plurality of light emitting diodes. The light source 500 may have an edge-type structure or a direct-bottom-type structure with respect to the liquid crystal display panel 100.

The light-source driver 600 may generate a light-source driving signal PWM_F of the variable frequency mode provided to the light source 500 based on a light-source controlling signal CPWM_F of the variable frequency mode provided from the timing controller 200. Also, the light-source driver 600 may generate a light-source driving signal PWM_N of the normal frequency mode provided to the light source 500 based on a light-source controlling signal CPWM_N of the normal frequency mode provided from the timing controller 200.

Figure 4:
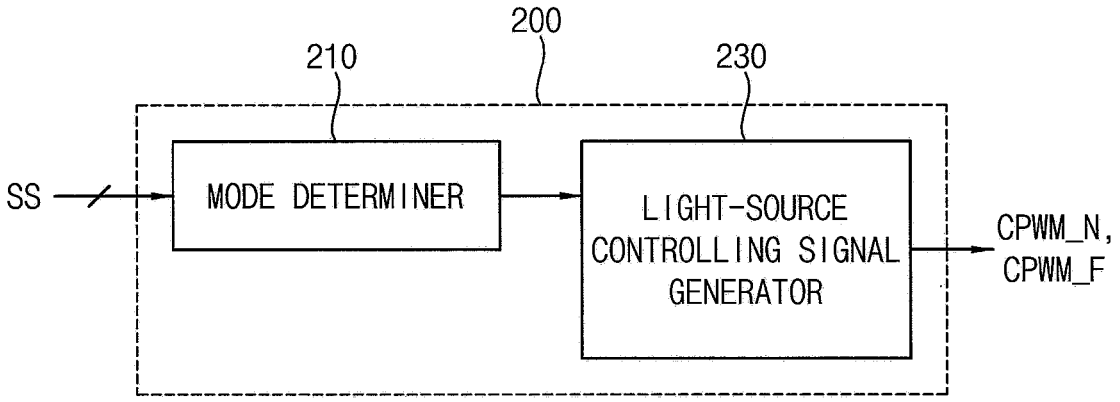
FIG. 4 is a block diagram illustrating a timing controller according to an exemplary embodiment.

FIG. 4 is a block diagram illustrating a timing controller according to an exemplary embodiment.

Referring to FIGS. 1 and 4, the timing controller 200 may include a frequency mode determiner 210 and a light-source controlling signal generator 230.

The frequency mode determiner 210 may determine whether the current frame is the normal frequency mode or the variable frequency mode using the synchronization signal SS.

For example, the timing controller 200 may count the synchronization signal SS in a vertical blank period of the frame. The counting value of the current frame may be compared with at least one reference counting value to determine whether the current frame is in the variable frequency mode or the normal frequency mode.

Alternatively, the counting value for the vertical blank period of the current frame, a counting value for a vertical blank period of a previous frame, and a counting value for a vertical blank period of a next frame may be compared with each other to determine whether the current frame is in the variable frequency mode or the normal frequency mode.

The determination method of the frequency mode is not limited to the method described above, and the frequency mode of the current frame may be determined using various frequency mode determination methods.

The light-source controlling signal generator 230 may generate a light-source controlling signal according to the frequency mode determined from the frequency mode determiner 210.

For example, when the current frame is in the normal frequency mode, a light-source controlling signal CPWM_N of the normal frequency mode may be generated to control the light source 500 to continue emitting light during the frame.

However, when the current frame is in the variable frequency mode, a light-source controlling signal CPWM_F of the variable frequency mode may be generated to control the light source 500 to emit light during a light-on period corresponding to an early period the frame and not emit light during a light-off period corresponding to a latter period of the frame. The light-off period may be a separate period from the light-on period.

According to an exemplary embodiment, in a variable frequency range that is from about 60 Hz to about 144 Hz, a length of the light-off period may be preset to an active length of a maximum frame frequency of 120 Hz to 144 Hz. The light-off period corresponding to a high frequency of 120 Hz or more may not be observable by the user.

According to an exemplary embodiment, the length of the light-on period may be preset to a frame length of 120 Hz.

According to an exemplary embodiment, the length of the light-on period may be preset to a frame length of 144 Hz.

According to an exemplary embodiment, the length of the light-on period may be preset to a frame length of a highest frequency higher than the fame length of 144 Hz.

According to an exemplary embodiment, when the frame length is shorter than the light-on period in the variable frequency mode, the light source 500 may continue to emit the light.

Therefore, even when the vertical blank period varies during the variable frequency mode, a flicker due to a luminance difference occurring in the variable frequency mode may be reduced or minimized because the same light-on period is applied.

The light-source controlling signal generator 230 generates a light-source controlling signal CPWM_N of the normal frequency mode in the normal frequency mode and provides the light source controlling signal CPWM_N to the light-source driver 600. The light-source controlling signal generator 230 generates a light-source controlling signal CPWM_F of the variable frequency mode in the variable frequency mode and provides the light source controlling signal CPWM_F to the light-source driver 600.

Figure 5:
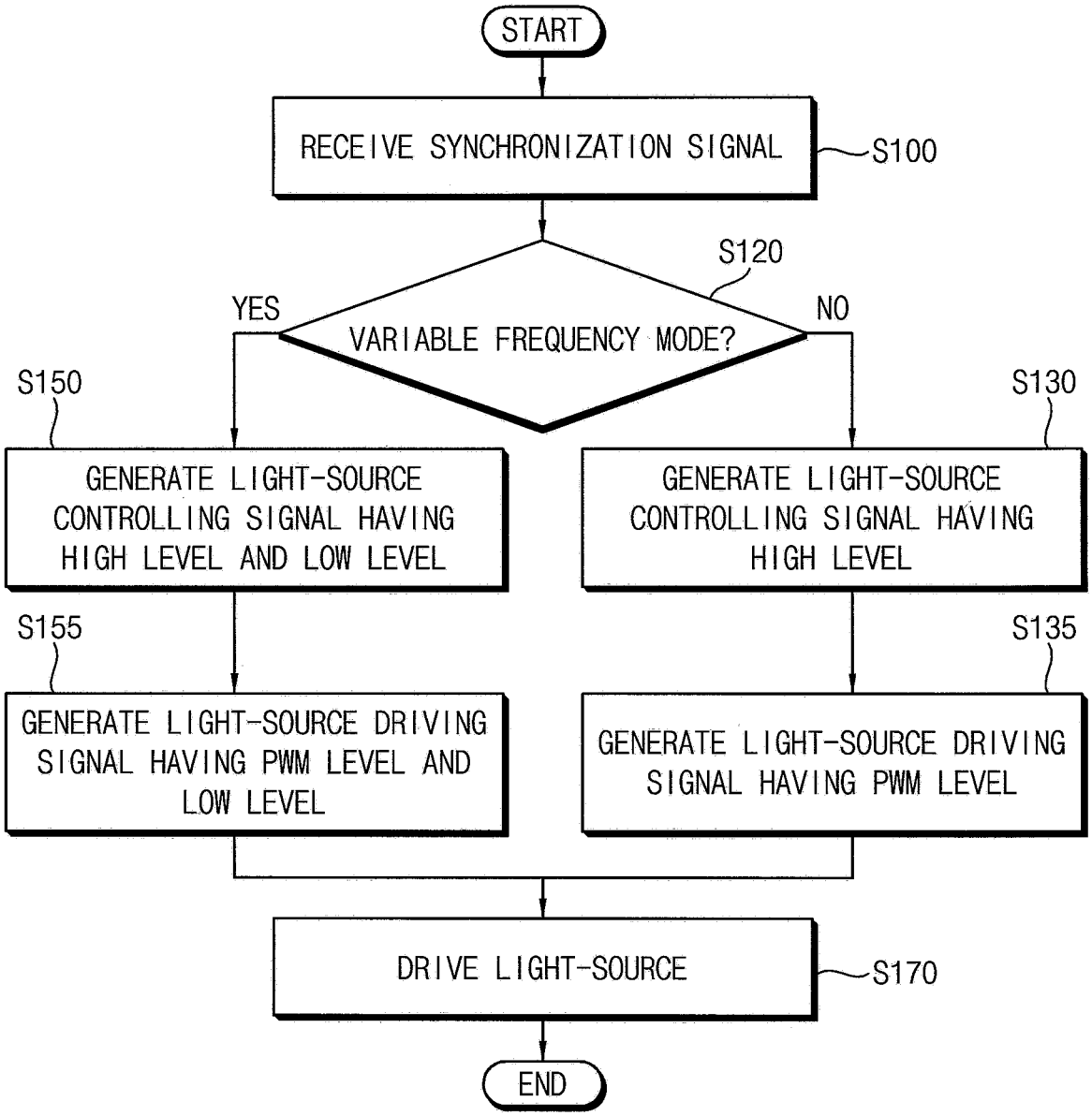
FIG. 5 is a flowchart diagram illustrating a method of driving a liquid crystal display device according to an exemplary embodiment.

FIG. 5 is a flowchart diagram illustrating a method of driving a liquid crystal display device according to an exemplary embodiment.

Referring to FIGS. 1 and 4-5, the timing controller 200 may receive the synchronization signal (Step S100).

The timing controller 200 may determine whether the current frame is the normal frequency mode or the variable frequency mode using the variable frequency range SS (Step S120).

For example, the timing controller 200 may count the synchronization signal SS in a vertical blank period of the frame. The counting value of the current frame may be compared with at least one reference counting value to determine whether the current frame is in the variable frequency mode or the normal frequency mode.

Alternatively, the counting value for the vertical blank period of the current frame, a counting value for a vertical blank period of a previous frame, and a counting value for a vertical blank period of a next frame may be compared with each other to determine whether the current frame is in the variable frequency mode or the normal frequency mode.

The determination method of the frequency mode is not limited to the method described above, and the frequency mode of the current frame may be determined using various frequency mode determination methods.

When the current frame is in the normal frequency mode, the timing controller 200 may generate a light-source controlling signal CPWM_N of the normal frequency mode to emit light from the light source 500 throughout the period of the frame (Step S130). For example, the light-source controlling signal CPWM_N in the normal frequency mode may always have a high level during the frame.

The timing controller 200 provides the light-source driver 600 with the light-source controlling signal CPWM_N of the normal frequency mode. The light-source driver 600 generates a light-source driving signal PWM_N of the normal frequency mode having a PWM level that continues to emit light from the light source 500 during the period of the frame based on the light-source controlling signal CPWM_N of the normal frequency mode (Step S135).

Thus, in the normal frequency mode, the light source 500 may continue to emit light throughout the period of the frame in response to the light-source driving signal PWM_N having the PWM level during the period of the frame (Step S170).

However, when the current frame is in the variable frequency mode, the timing controller 200 may generate a light-source controlling signal CPWM_F of the variable frequency mode to emit the light of the light source 500 during the light-on period corresponding to an early period the frame and not to emit the light of the light source 500 during the light-off period corresponding to a latter period of the frame except for the light-on period (Step S150). The light-source controlling signal CPWM_F of the variable frequency mode may have a high level in the light-on period and a low level in the light-off period.

The timing controller 200 may provide the light-source control signal CPWM_F of the variable frequency mode to the light-source driver 600. The light-source driver 600 may generate the light-source driving signal PWM_F of the variable frequency mode that has the PWM level during the light-on period and a low level during the light-off period based on the light-source controlling signal CPWM_F of the variable frequency mode (Step S155).

Thus, in the variable frequency mode, the light source 500 may emit light only during the light-on period in response to the light-source driving signal PWM_F that has the PWM level during the light-on period and the low level during the light-off period (Step S170).

For example, in the variable frequency mode, the light source 500 may continually emit light during a frame period whose frame length is shorter than the light-on period depending on the frame frequency. In addition, the light source 500 may emit light only during the light-on period of the frame period whose frame length is longer than the light-on period depending on the frame frequency.

According to an exemplary embodiment, even when the vertical blank period varies during the variable frequency mode, a flicker due to a luminance difference occurring in the variable frequency mode may be reduced or minimized because the same light-on period may be applied.

Figure 6:
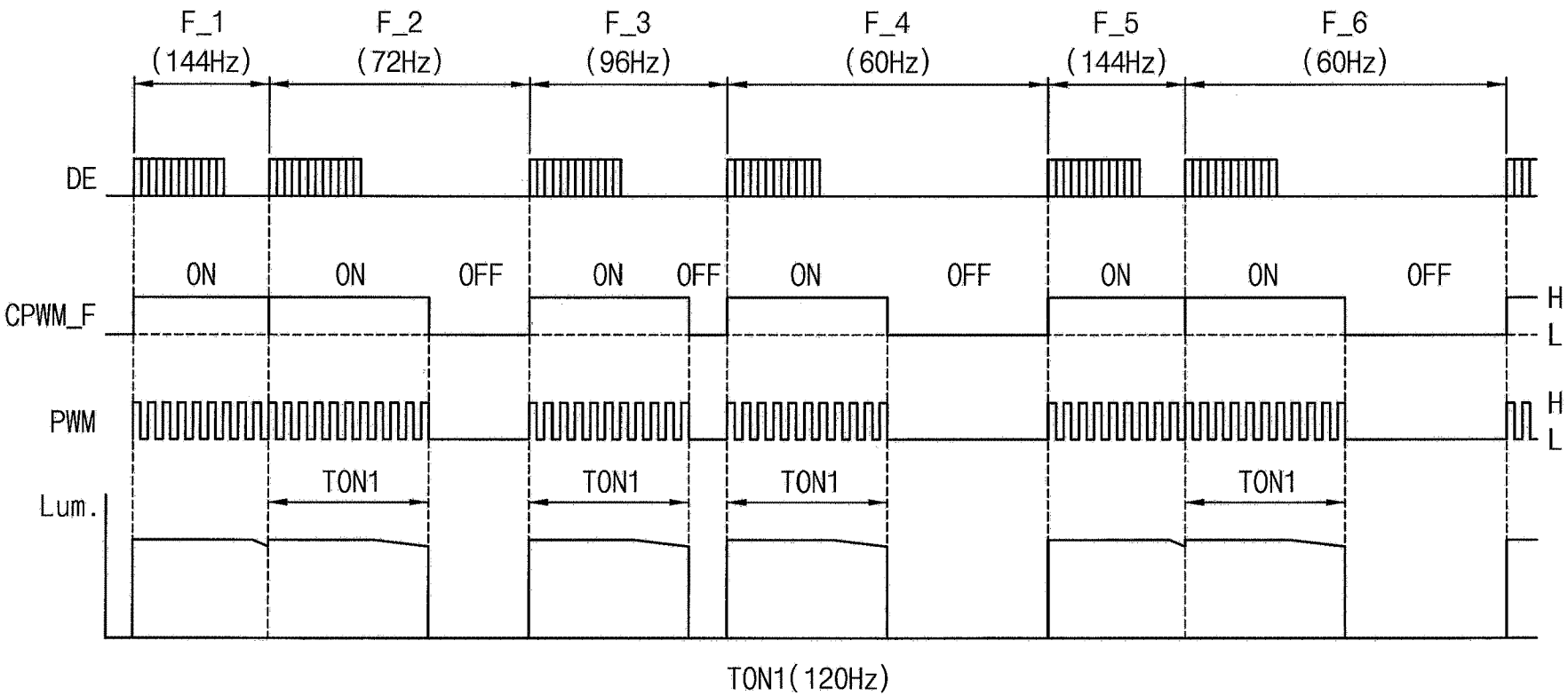
FIG. 6 is a waveform diagram illustrating a method of driving a liquid crystal display device in a variable frequency mode according to an exemplary embodiment.

FIG. 6 is a waveform diagram illustrating a method of driving a liquid crystal display device in a variable frequency mode according to an exemplary embodiment.

Referring to FIG. 6, according to an exemplary embodiment, in the variable frequency mode, the frame frequency of the plurality of frames may include a variable frequency range of about 60 Hz to about 144 Hz, the light-on period during which the light source emits light may be preset to a frame length TON1 of 120 Hz (e.g., a frame length based on a frame frequency of 120 Hz).

The timing controller may determine a frame frequency of a first frame F_1 based on the data enable signal DE received in the first frame F_1. The timing controller may generate a light-source controlling signal CPWM_ F corresponding to the first frame F_1 of 144 Hz. The first frame F_1 of the 144 Hz may have a length (e.g., a frame length based on a frame frequency of 144 Hz) shorter than the length of the light-on period preset by the frame length of 120 Hz (e.g., a frame length based on a frame frequency of 120 Hz). Thus, the light-source controlling signal corresponding to the first frame F_1 may have a high level H throughout the first frame F_1. Based on the light-source controlling signal of the high level, the light-source driver may provide the light source with a light-source driving signal PWM_F having the PWM level. The light source may continue to generate the light during the first frame F_1 of 144 Hz in response to the light-source driving signal PWM_F of the PWM level.

The timing controller may determine a frame frequency of a second frame F_2 based on the data enable signal DE received in the second frame F_2. The timing controller may generate a light-source controlling signal CPWM_F corresponding to the second frame F_2 of 72 Hz. The light-source control signal CPWM_F corresponding to the second frame F_2 may have a high level H for a light-on period ON preset to the frame length of 120 Hz which may be an early period of the second frame F_2 and a low level L for a light-off period OFF which may be a latter period of the second frame F_2. The light-source driver may generate a light-source driving signal PWM_F of the second frame F_2 having the PWM level for the light-on period ON and a low level L for the light-off period OFF, and may provide the light-source driving signal PWM_F to the light source. The light source may emit light during the light-on period ON and may not emit light during the light-off period OFF in the second frame F_2 of 72 Hz.

The timing controller may determine a frame frequency of a third frame F_3 based on the data enable signal DE received in the third frame F_3. The timing controller may generate a light-source controlling signal CPWM_F corresponding to the third frame F_3 of 96 Hz. The light-source control signal CPWM_F corresponding to the third frame F_3 may have a high level H for a light-on period ON preset to the frame length of 120 Hz which is an early period of the third frame F_3 and a low level L for a light-off period OFF which is a latter period of the third frame F_3. The third frame F_3 of 96 Hz may have a shorter light-off period than the second frame F_2 of 72 Hz. The light-source driver may generate a light-source driving signal PWM_F of the third frame F_3 having the PWM level for the light-on period ON and a low level L for the light-off period OFF, and may provide the light-source driving signal PWM_F to the light source. The light source may emit light during the light-on period ON and may not emit light during the light-off period OFF in the third frame F_3 of 96 Hz.

As described above, the light source may emit light only during the light-on period corresponding to the frame length of 120 Hz for each frame in the variable frequency mode.

Therefore, even if the vertical blank period varies in the variable frequency mode, the light source emits light only during the light-on period corresponding to the frame length of 120 Hz which is preset early in the frame. The luminance difference due to the variable difference of the vertical blank period may be reduced or minimized.

Figure 7:
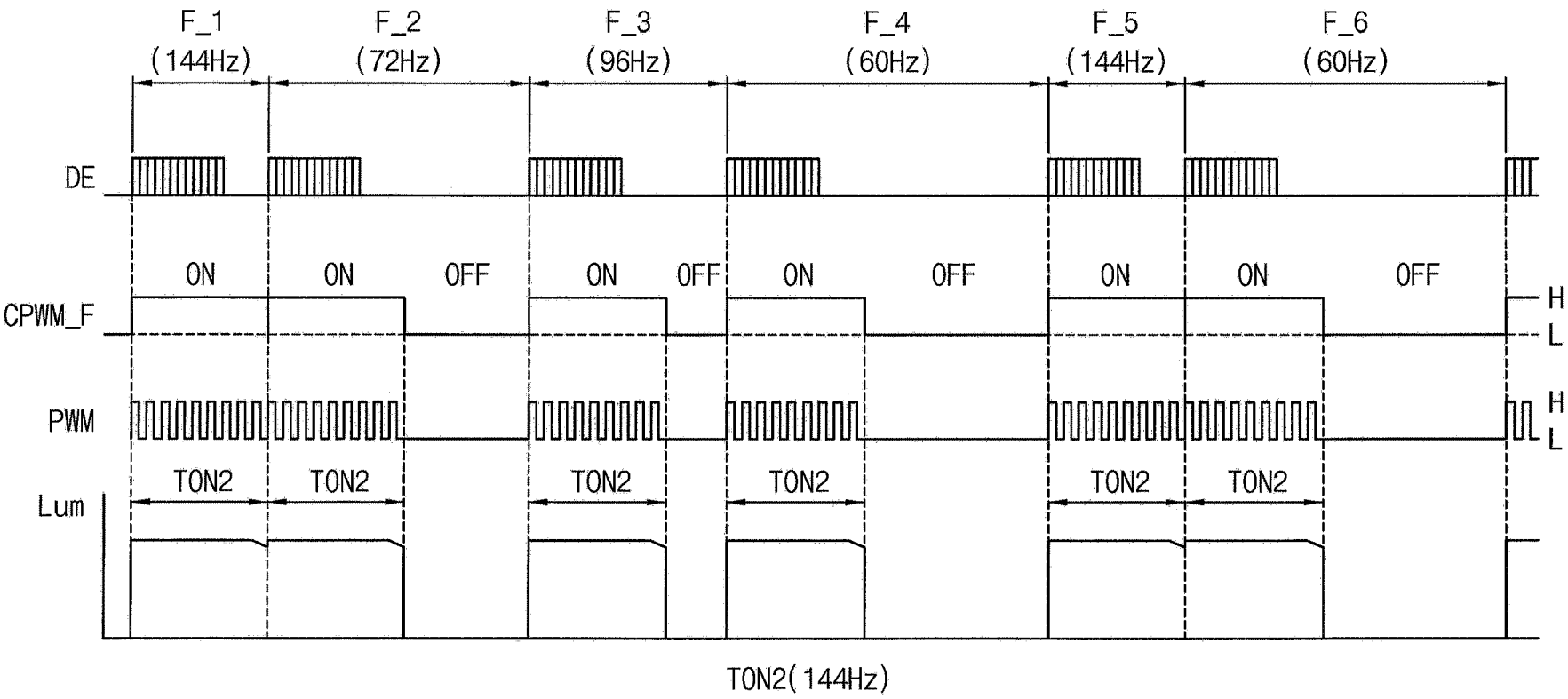
FIG. 7 is a waveform diagram illustrating a method of driving a liquid crystal display device in a variable frequency mode according to an exemplary embodiment.

FIG. 7 is a waveform diagram illustrating a method of driving a liquid crystal display device in a variable frequency mode according to an exemplary embodiment.

Referring to FIG. 7, according to an exemplary embodiment, in the variable frequency mode, the frame frequency of the plurality of frames may include a variable frequency range of about 60 Hz to about 144 Hz, the light-on period during which the light source emits light may be preset to a frame length TON2 of 144 Hz.

The timing controller may determine a frame frequency of a first frame F_1 based on the data enable signal DE received in the first frame F_1. The timing controller may generate a light-source controlling signal CPWM_F corresponding to the first frame F_1 of 144 Hz. The first frame F_1 of the 144 Hz may have a length equal to the length of the light-on period preset by the frame length of 144 Hz and thus, the light-source controlling signal corresponding to the first frame F_1 has a high level H throughout the first frame F_1. Based on the light-source controlling signal of the high level, the light-source driver may provide the light source with a light-source driving signal PWM_F having the PWM level. The light source may continue to generate the light during the first frame F_1 of 144 Hz in response to the light-source driving signal PWM_F of the PWM level.

The timing controller may determine a frame frequency of a second frame F_2 based on the data enable signal DE received in the second frame F_2. The timing controller may generate a light-source controlling signal CPWM_F corresponding to the second frame F_2 of 72 Hz. The light-source control signal CPWM_F corresponding to the second frame F_2 may have a high level H for a light-on period ON preset to the frame length of 144 Hz which is an early period of the second frame F_2 and a low level L for a light-off period OFF which is a latter period of the second frame F_2. The light-source driver may generate a light-source driving signal PWM_F of the second frame F_2 having the PWM level for the light-on period ON and a low level L for the light-off period OFF, and provides the light-source driving signal PWM_F to the light source. The light source may emit light during the light-on period ON and may not emit the light during the light-off period OFF in the second frame F_2 of 72 Hz.

The timing controller may determine a frame frequency of a third frame F_3 based on the data enable signal DE received in the third frame F_3. The timing controller may generate a light-source controlling signal CPWM_F corresponding to the third frame F_3 of 96 Hz. The light-source control signal CPWM_F corresponding to the third frame F_3 may have a high level H for a light-on period ON preset to the frame length of 144 Hz which is an early period of the third frame F_3 and a low level L for a light-off period OFF which is a latter period of the third frame F_3. The third frame F_3 of 96 Hz may have a shorter light-off period than the second frame F_2 of 72 Hz. The light-source driver may generate a light-source driving signal PWM of the third frame F_3 having the PWM level for the light-on period ON and a low level L for the light-off period OFF, and provides the light-source driving signal PWM to the light source. The light source may emit light during the light-on period ON and may not emit the light during the light-off period OFF in the third frame F_3 of 96 Hz.

As described above, the light source may emit the light only during the light-on period corresponding to the frame length of 144 Hz for each frame in the variable frequency mode.

Therefore, even if the vertical blank period varies in the variable frequency mode, the light source may emit light only during the light-on period corresponding to the frame length of 144 Hz which is preset early in the frame. The luminance difference due to the variable difference of the vertical blank period may be reduced or minimized.

Figure 8:
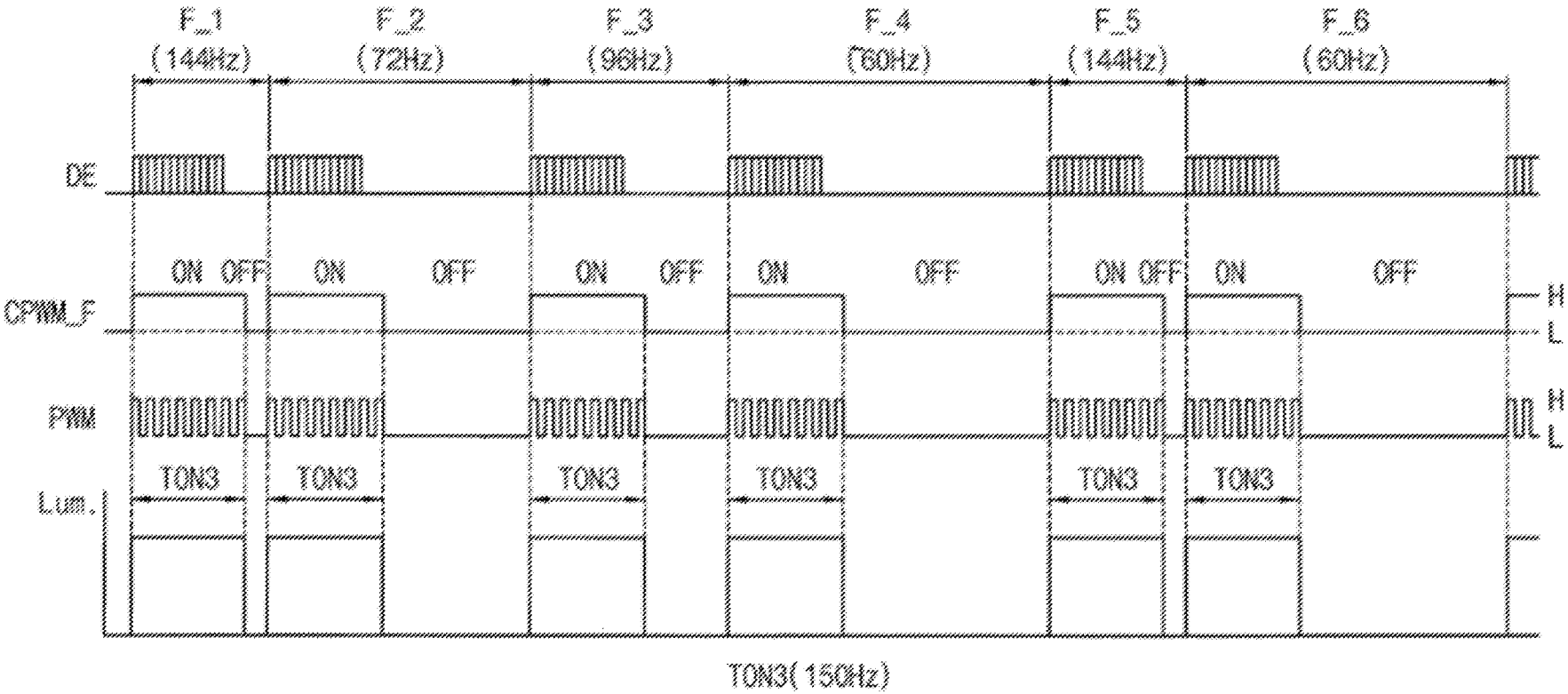
FIG. 8 is a waveform diagram illustrating a method of driving a liquid crystal display device in a variable frequency mode according to an exemplary embodiment.

FIG. 8 is a waveform diagram illustrating a method of driving a liquid crystal display device in a variable frequency mode according to an exemplary embodiment.

Referring to FIG. 8, according to an exemplary embodiment, in the variable frequency mode, the frame frequency of the plurality of frames may include a variable frequency range of about 60 Hz to about 144 Hz, the light-on period during which the light source emits light may be preset to a frame length TON3 of 150 Hz that is a high frequency being higher than 120 Hz.

The timing controller may determine a frame frequency of a first frame F_1 based on the data enable signal DE received in the first frame F_1. The timing controller may generate a light-source controlling signal CPWM_F corresponding to the second frame F_2 of 144 Hz. The light-source control signal CPWM_F corresponding to the first frame F_1 may have a high level H for a light-on period ON preset to the frame length of 150 Hz which is an early period of the first frame F_1 and a low level L for a light-off period OFF which is a latter period of the first frame F_1. The light-source driver may generate a light-source driving signal PWM_F of the first frame F_1 having the PWM level for the light-on period ON and a low level L for the light-off period OFF, and may provides the light-source driving signal PWM_F to the light source. The light source may emit light during the light-on period ON and may not emit the light during the light-off period OFF in the first frame F_1 of 144 Hz.

The timing controller may determine a frame frequency of a second frame F_2 based on the data enable signal DE received in the second frame F_2. The timing controller may generate a light-source controlling signal CPWM_F corresponding to the second frame F_2 of 72 Hz. The light-source control signal CPWM_F corresponding to the second frame F_2 may have a high level H for a light-on period ON preset to the frame length of 150 Hz which is an early period of the second frame F_2 and a low level L for a light-off period OFF which is a latter period of the second frame F_2. The light-source driver may generate a light-source driving signal PWM_F of the second frame F_2 having the PWM level for the light-on period ON and a low level L for the light-off period OFF, and may provide the light-source driving signal PWM to the light source. The light source may emit light during the light-on period ON and may not emit the light during the light-off period OFF in the second frame F_2 of 72 Hz.

The timing controller may determine a frame frequency of a third frame F_3 based on the data enable signal DE received in the third frame F_3. The timing controller may generate a light-source controlling signal CPWM_F corresponding to the third frame F_3 of 96 Hz. The light-source control signal CPWM_F corresponding to the third frame F_3 may have a high level H for a light-on period ON preset to the frame length of 150 Hz which is an early period of the third frame F_3 and a low level L for a light-off period OFF which is a latter period of the third frame F_3. The third frame F_3 of 96 Hz may have a shorter light-off period than the second frame F_2 of 72 Hz and a longer light-off period than the first frame F_1 of 144 Hz. The light-source driver may generate a light-source driving signal PWM_F of the third frame F_3 having the PWM level for the light-on period ON and a low level L for the light-off period OFF, and may provide the light-source driving signal PWM_F to the light source. The light source may emit light during the light-on period ON and may not emit the light during the light-off period OFF in the third frame F_3 of 96 Hz.

As described above, the light source may emit light only during the light-on period corresponding to the frame length of 150 Hz for each frame in the variable frequency mode.

Therefore, even if the vertical blank period varies in the variable frequency mode, the light source emits light only during the light-on period corresponding to the frame length of 150 Hz which is preset early in the frame. The luminance difference due to the variable difference of the vertical blank period may be reduced or minimized.

According to exemplary embodiments, even when the vertical blank period varies during the variable frequency mode, a flicker due to a luminance difference occurring in the variable frequency mode may be reduced or minimized because the same light-on period is applied. However, a black insertion corresponding to the light-off period according to the light-on period may not be observed by the user as a high-frequency component. Therefore, the display quality of the image may be improved in the variable frequency mode. The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

When a first element is described as being "connected" to a second element, the first element may be directly "connected" to the second element, or one or more other intervening elements may be located between the first element and the second element. In contrast, when an element or layer is referred to as being "directly connected to" another element or layer, there are no intervening elements or layers present.

As used herein, the term "about," and similar terms are used as terms of approximation and not as terms of degree, and are intended to account for the inherent deviations in measured or calculated values that would be recognized by those of ordinary skill in the art. Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

As used herein, the term "using" may be considered synonymous with the term "utilizing."

The electronic or electric devices and/or any other relevant devices or components according to embodiments of the present disclosure described herein, such as, for example, an external controller, a timing controller, power management circuit, a data driver, and a gate driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A liquid crystal display device comprising:

a liquid crystal display panel;

a timing controller configured to output a light-source controlling signal during a variable frequency mode comprising a plurality of frames with variable frame frequencies, the light-source controlling signal having a high level during a light-on period preset in an early period of a frame of the plurality of frames and a low level during a light-off period preset to a length according to a frame frequency in a latter period of the frame of the plurality of frames; and a light source configured to emit light during the light-on period and not emit light during the light-off period in response to the light-source controlling signal, wherein the timing controller is configured to output the light-source controlling signal having the high level throughout the frame of the plurality of frames when the length of the frame of the plurality of frames is shorter than the light-on period during the variable frequency mode.

2. The liquid crystal display device of claim 1, wherein the timing controller comprises:

a frequency mode determiner configured to determine whether a frequency mode is the variable frequency mode using a synchronization signal; and a light-source controlling signal generator configured to generate the light-source controlling signal when the frequency mode is the variable frequency mode.

3. The liquid crystal display device of claim 2, wherein the frequency mode determiner is configured to determine the frequency mode using a counting value of the synchronization signal corresponding to a vertical blank period of the frame of the plurality of frames.

4. The liquid crystal display device of claim 1, wherein the timing controller is configured to output a light-source controlling signal having the high level throughout the frame of the plurality of frames during a normal frequency mode comprising a plurality of frames with constant frame frequencies.

5. The liquid crystal display device of claim 1, wherein the length of the light-on period corresponds to a frame length of 120 Hz.

6. The liquid crystal display device of claim 1, wherein the length of the light-on period corresponds to a frame length of a highest frequency from among a variable frequency range in the variable frequency mode.

7. The liquid crystal display device of claim 1, wherein the length of the light-on period corresponds to a frame length of a frequency higher than a highest frequency from among a variable frequency range in the variable frequency mode.

8. The liquid crystal display device of claim 1, further comprising:

a light-source driver configured to generate a light-source driving signal having a pulse width modulation level corresponding to the high level of the light-source controlling signal and a low level corresponding to the low level of the light-source controlling signal.

9. A method of driving a liquid crystal display device, the method comprising:

outputting a light-source controlling signal during a variable frequency mode comprising a plurality of frames with variable frame frequencies, the light-source controlling signal having a high level during a light-on period preset in an early period of a frame of the plurality of frames and a low level during a light-off period preset to a length according to a frame frequency in a latter period of the frame of the plurality of frames;

lighting a liquid crystal display panel during the light-on period of the frame based on the light-source controlling signal during the variable frequency mode; and not lighting the liquid crystal display panel during the light-off period of the frame based on the light-source controlling signal during the variable frequency mode, wherein the method further comprises outputting the light-source controlling signal having the high level throughout the frame of the plurality of frames when the length of the frame of the plurality of frames is shorter than the light-on period in the variable frequency mode.

10. The method of claim 9, further comprising:

determining whether a frequency mode is the variable frequency mode using a synchronization signal; and generating the light-source controlling signal when the frequency mode is the variable frequency mode.

11. The method of claim 10, wherein the frequency mode is determined using a counting value of the synchronization signal corresponding to a vertical blank period of the frame of the plurality of frames.

12. The method of claim 9, further comprising:

outputting a light-source controlling signal having the high level throughout the frame of the plurality of frames during a normal frequency mode which includes a plurality of frames with constant frame frequencies.

13. The method of claim 9, wherein the length of the light-on period corresponds to a frame length of 120 Hz.

14. The method of claim 9, wherein the length of the light-on period corresponds to a frame length of a highest frequency from among a variable frequency range in the variable frequency mode.

15. The method of claim 9, wherein the length of the light-on period corresponds to a frame length of a frequency higher than a highest frequency from among a variable frequency range in the variable frequency mode.

16. The method of claim 9, further comprising:

generating a light-source driving signal having a pulse width modulation level corresponding to the high level of the light-source controlling signal and a low level corresponding to the low level of the light-source controlling signal; and providing the light-source driving signal to a light source.

* * * * *